United States Patent [19]

Lawson et al.

[11] 3,949,116

[45] Apr. 6, 1976

[54] METHOD OF DEVELOPING AN ELECTROSTATIC LATENT IMAGE IN WHICH SHEAR STRESS IS EMPLOYED

[75] Inventors: Terence M. Lawson, Aldgate; Blair D. Howell, Lockleys, both of Australia

[73] Assignee: Research Laboratories of Australia Pty. Limited, Eastwood, Australia

[22] Filed: June 10, 1974

[21] Appl. No.: 477,924

[30] Foreign Application Priority Data

May 1, 1974 Australia ..... 7402/74

[52] U.S. Cl. ..... 427/17; 96/1 LY; 252/62.1 L

[51] Int. Cl.[2] ..... G03G 13/06; G03G 9/08

[58] Field of Search ..... 96/1 LY; 117/37 LE; 252/62.1 L; 427/15, 17

[56] References Cited

UNITED STATES PATENTS

| | | | |
|---|---|---|---|
| 3,247,007 | 4/1966 | Oliphant | 117/37 LE |
| 3,579,451 | 5/1971 | Sciambi | 96/1 LY X |
| 3,627,557 | 12/1971 | Sato et al. | 427/17 |
| 3,692,520 | 9/1972 | Mammino et al. | 117/37 LE X |
| 3,839,032 | 10/1974 | Smith et al. | 117/37 LE X |

FOREIGN PATENTS OR APPLICATIONS

| | | | |
|---|---|---|---|
| 271,046 | 2/1965 | Australia | 96/1 LY |

*Primary Examiner*—Ronald H. Smith
*Assistant Examiner*—John R. Miller
*Attorney, Agent, or Firm*—Kinzer, Plyer, Dorn & McEachran

[57] ABSTRACT

The method of developing an electrostatic latent image contained on a surface comprising the steps of applying to a surface a dispersion in a first state wherein the flow properties of the dispersion are non-Newtonian and wherein the dispersion consists of a liquid phase and of a solid phase comprising flocculated electroscopic marking particles forming a matrix sufficiently strong to prevent extraction of individual electroscopic marking particles from the matrix and applying to the dispersion a shear stress of sufficient magnitude to convert the dispersion from the first state to a second state wherein the flow properties of said dispersion become Newtonian and wherein said solid phase is deflocculated.

7 Claims, 2 Drawing Figures

Figure 1:
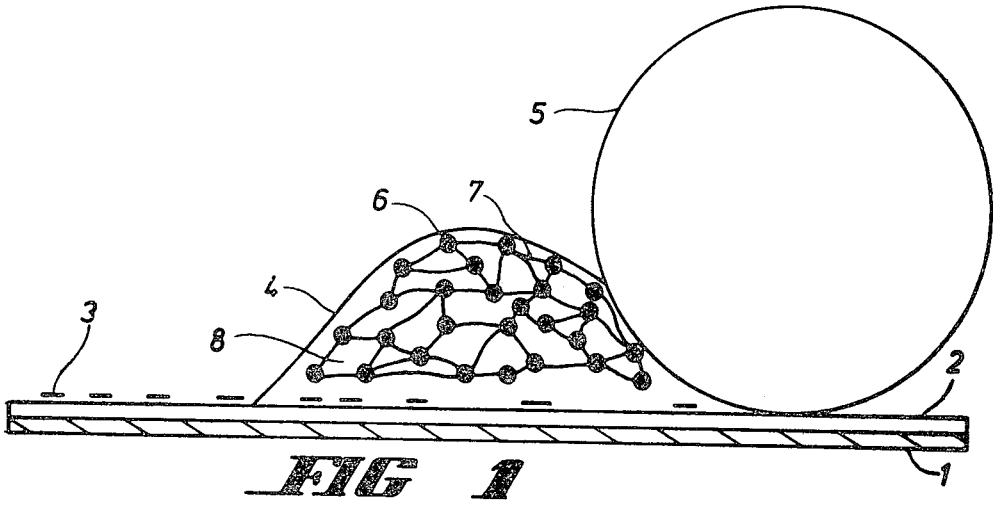

METHOD OF DEVELOPING AN ELECTROSTATIC LATENT IMAGE IN WHICH SHEAR STRESS IS EMPLOYED

BACKGROUND OF THE INVENTION

In electrostatic printing it is generally required to render visible or develop a latent image defined by electrostatic charges contained on a dielectric or insulative surface of a recording member. Such recording member may be a photoconductor as used in the commonly known process of electrophotography or xerography, or a dielectric material as used in facsimile recording or computer printout and the like. The term electrostatic printing also applies to other methods of latent electrostatic image formation and rendering visible same, such as for instance to those methods where a latent electrostatic image is formed on a surface by the so-called Dember effect, of by thermal means, or by physical means such as pressure or impact and the like.

The electrostatic latent images thus formed are rendered visible or developed in accordance with prior art practices by the application to the surface of electroscopic marking particles which are more or less selectively attracted to or repelled by the electrostatic charges defining the latent image, depending whether a direct or a reversal reproduction is desired. In the case of direct reproduction the electroscopic marking particles are deposited in the latent image areas, whereas in the case of reversal re-production the particles are deposited outside the latent image areas.

Such prior art methods of development fall into two distinct categories, namely the so-called dry development method and the so-called liquid development method. Both these methods are widely known.

Dry development involves the attraction of electroscopic marking particles or so-called dry toners to the surface bearing the electrostatic latent image, such electroscopic marking particles being applied in the form of a powder cloud or carried on a triboelectrically different carrier particle.

In liquid development the surface containing the electrostatic latent image is contacted with a so-called liquid toner which comprises a dispersion of electroscopic marking particles in an insulating carrier liquid having a volume resistivity in excess of $10^9$ ohm-cm and a dielectric constant less than 3.0. The electroscopic marking particles or toner particles are attracted from said carrier liquid to the electrostatic latent image and deposited on the surface containing said image. The electroscopic marking particles usually are comprised of pigment as coloring matter and resins or varnishes or oils which serve as dispersing aids, and fixing agents and can also confer the desired polarity and charge or sensitivity onto said particles.

In both dry and liquid methods of development the image formed on the surface of the recording member can be fixed thereon or transferred onto another surface if so desired.

Prior art toners and toner applicators, although very effective in many instances, suffer from inherent disadvantages. Thus dry toners are generally of limited resolution owing to the relatively large size of the toner particles, and in addition are only capable of achieving large area fill-in when complicated developing techniques are used. Further dry toners are generally not self-fixing and are commonly fixed by fusion after image development, which requires the application of considerable heat to melt the particles.

Liquid toners are generally applied to the recording member by a dip and squeegee system as commonly practised for instance in electrostatic office copiers employing as the recording member paper coated on one side thereof with a photoconductive coating comprising Zinc Oxide in an insulating binder. Biasing means are often used in such toner applicators to enhance image development. However due to the nature of the liquid toners and of the applicators used for same this method suffers from the disadvantage that the surface to be developed must be wetted with the toner dispersion and in most cases both sides of the recording member are wetted. Accordingly it is necessary to use a squeegee system in most cases in combination with the application of heat or a stream of warm or hot air to remove the liquid carried out by the recording member in order that the emerging copy may be sufficiently dry and the image fixed for handling purposes. This results in evaporation of the carried out liquid into the atmosphere, causing pollution of the environment with hydrocarbon vapor, and in addition a considerable quantity of carrier liquid is wasted in this manner.

Liquid toners as composed and as applied in the prior art suffer from the further disadvantage that they are relatively slow in developing action and thus place a limit on recording speed when attainment of a certain image quality is required.

Furthermore liquid toners containing a plurality of components such as polarity control agents, dispersing aids and fixing materials are generally of limited shelf life, due to chemical reaction between the components or to component aging or polymerisation or settling and the like.

It is also known that mainly due to the non-homogeneous particle size and particle charge of liquid toners it is not readily possible to develop continuous tone images, that is to say subject matter requiring true grey scale reproduction.

SUMMARY OF THE INVENTION

It is an object of the present invention to provide a method of and means for developing electrostatic latent images overcoming the above noted deficiencies.

Another object of this invention is to provide a method of and means for developing electrostatic latent images whereby liquid carry-out by the recording member is reduced virtually to boundary layer thickness.

Yet another object of this invention is to provide a method of and means for developing electrostatic latent images without the need for application of heat or air to dry the recording member.

A further object of this invention is to provide a method of and means for developing electrostatic latent images whereby environmental pollution by hydrocarbon vapors is substantially reduced over prior art methods.

A still further object of this invention is to provide a method of and means for developing electrostatic latent images whereby liquid wastage is substantially reduced over prior art methods.

Another object of this invention is to provide means for developing electrostatic latent images comprising a composition having long shelf life stability.

Yet another object of this invention is to provide a method of and means for developing electrostatic latent images whereby continuous tone or grey scale images can be reproduced.

Still another object of this invention is to provide a method of and means for high speed development of electrostatic latent images.

Other advantages of the method of the present invention will become apparent from the following description.

In the specifications of our earlier Australian Letters Pat. Nos. 261,010 and 274,610 there are described methods which used developer materials such as cellulose polymer capable of forming a matrix or bonded flocculent structure when partly dissolved or dispersed in certain liquids. In said methods however the cellulose polymer and other like materials were used in a substantially dissolved state in the carrier liquids employed for the developer and accordingly such liquids were characterized by relatively high solvent power. Furthermore in both aforesaid methods the developer was applied to the surface carrying the electrostatic latent image to be developed in the form of a free flowing liquid containing only a relatively small proportion of the electroscopic toner material and thus image development was attained by the unrestrained migration of such electroscopic toner material such as cellulose polymer and the like materials to the surface to be developed and deposition thereon due to attraction by forces associated with the electrostatic latent image contained on said surface. The present invention is in part, at least, an extension of the principle of utilization of cellulose polymers and other like materials as developer constituents, but this invention differs from the aforesaid methods in the use of such materials in quantity and combination as well as selection of dispersing liquid. We have namely found now that if the cellulose polymers and other like materials are used in relatively high proportions in combination with other materials in dispersed or substantially undissolved state in liquids of low solvent power there results a composition useful for the development of electrostatic latent images in which composition the developer material or toner particles are joined by bonds forming a matrix or bonded flocculent structure whereby the flow properties of the composition become non-Newtonian and whereby the developing material is restrained from migration to the surface to be developed and deposition thereon due to attraction by forces associated with the electrostatic latent image contained on said surface until sufficient shear exists to free the toner particles for development.

According to this invention the toners are essentially dispersions of a solid particulate phase in a liquid phase. The particulate solid phase and the liquid phase are so selected that the particulate matter is dispersed in a strongly flocculated state, hereinafter called the first state. In this first state the flocculated particulate matter forms a matrix, that is to say the particles are substantially linked or bonded to each other and the liquid phase is contained substantially within such matrix and surrounding same. In this first state the toner dispersion possesses non-Newtonian pseudo-plastic or plastic or thixotropic flow properties, that is to say the dispersion requires a certain applied shear force before Newtonian flow occurs, in which state the solid particulate phase is deflocculated, this state being called henceforth the second state.

When the above described toner is applied in said first state to a surface containing an electrostatic latent image by for instance pouring over the surface or by means of an applicator roller without any pressure, that is to say when there is no shear stress applied to the toner except some stress due to gravity, we have found that such toner cannot be used or considered as a toner in the sense of prior art definition in that the electrostatic latent image contained on said surface is not developed at all, or if so, only to a relatively low density, whilst the whole surface including the background area becomes heavily coated by the toner adhering to the surface and drying rapidly thereon.

If, however, when applying the toner in said first state to a surface containing an electrostatic latent image a shear stress of appropriate magnitude is applied simultaneously or subsequently to the toner for instance by means of roller pressure and the toner is moved over said surface whilst under the influence of said shear stress, we have found that the electrostatic latent images contained on said surface are developed to high density, whilst the background areas remain free of toner deposit and furthermore the liquid phase wets the surface only superficially and consequently in cases where for instance the surface is contained on an absorbent substrate such as paper liquid penetration into same and liquid carry-out are only slight.

Thus our invention can be summed up as a method of developing electrostatic latent images contained on a surface, such as for instance the surface of an electrophotographic or electrostatic recording member, in which method a toner dispersion is used which comprises a liquid phase and a dispersed solid phase consisting of electroscopic marking particles in a first state in which the flow properties of the toner are non-Newtonian and the electroscopic marking particles comprising the solid phase are flocculated forming a matrix which is structurally strong enough to prevent the extraction from it of individual electroscopic marking particles, which in this state are parts of the matrix, by attraction to the electroscopic latent image. If now a shear stress is applied to the toner, for instance by means of roller pressure, the toner is converted from the first state to a second state in which the flow properties of the toner become Newtonian and the solid phase becomes deflocculated. When this occurs the matrix is broken up into individual electroscopic marking particles which now form the dispersed phase, and in this state the electroscopic marking particles can be attracted by the electroscopic latent image and deposited onto the surface to give highly effective development of the image.

Figure 2:
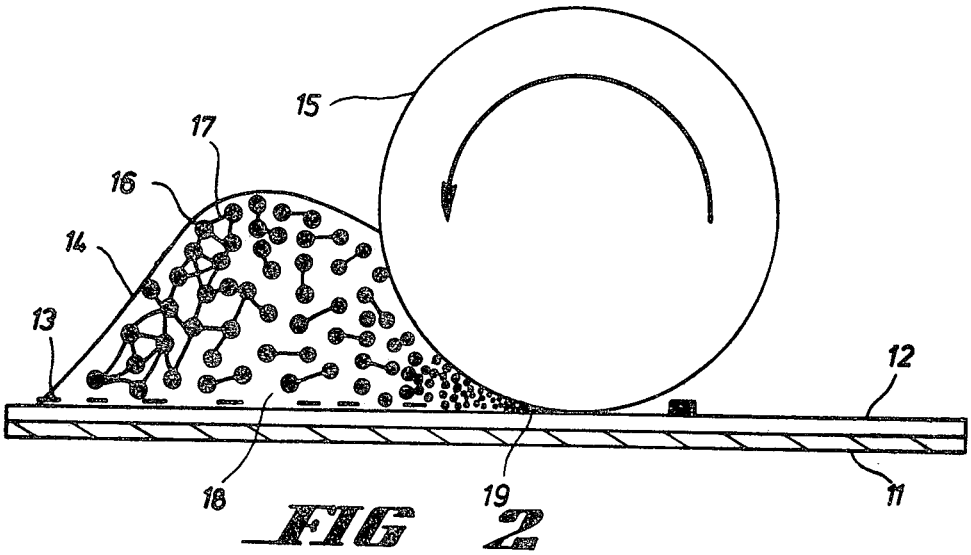

Without wishing to be bound by any theory regarding the cause for the above described effects, we submit the following explanation for the functioning of our invention which will be better understood with reference to the following drawings, in which:

FIG. 1 illustrates the condition of the toner in the first state prior to the commencement of development, and FIG. 2 illustrates the condition of the toner in the second state when developing action is attained in accordance with this invention.

Referring now to FIG. 1 in detail, an electrostatic recording member consisting of a base or backing material 1 having coated thereon an insulative or dielectric layer 2 which contains electrostatic latent image 3 on its surface is positioned on a suitable support (not shown here) and a pool 4 of toner in said first state is applied or formed as a strip across the surface of said dielectric layer 2. A roller 5 is positioned adjacent to toner pool 4. Toner pool 4 in this first state consists of a solid phase comprised of strongly flocculated electroscopic marking particles 6 forming a matrix as shown by symbolically represented interparticulate bonds or bonding forces 7 and of a liquid phase 8 which as will be seen is contained within and surrounding said solid phase matrix. This figure shows a static condition.

In FIG. 2 the dynamic condition is shown. In this the electrostatic recording member consists of a base or backing material 11 having coated thereon an insulative or dielectric layer 12 which contains electrostatic latent images 13 on its surface and such recording member is positioned on a suitable support (not shown here). Roller 15 is now moved or rolled in the direction shown across dielectric surface 12 whilst pressure is applied between said roller 15 and said surface 12 in a direction normal to said surface 12. As roller 15 is moved in the direction shown across dielectric surface 12, the toner pool 14, is also moved as a strip ahead of the roller 15 across the surface 12. This results in the progressive application of shear stress to the toner pool 14 and the magnitude of such shear stress varies from a value of zero at the leading edge of said toner pool 14 in the zone most remote from roller 15 to the maximum value in the zone near the line of contact between roller 15 and the dielectric surface 12. Thus as the shear stress is progressively applied to toner pool 15 so said solid phase matrix structure formed by electroscopic marking particles 16 and symbolically represented interparticulate bonds or bonding forces 17 progressively undergoes breakdown by deflocculation of the solid phase. Thus it will be seen that the solid phase remains in the strongly flocculated matrix form previously defined as the first state in the leading edge zone where there is no shear stress whereas in the middle zone of toner pool 14 where the magnitude of shear stress progressively increases in proportion with the deformation of said toner pool caused by the pressure of roller 15 the matrix breaks up firstly by partial deflocculation followed by deflocculation of all linked or bonded large particle aggregates in the zone closer to the roller 15 with increasing shear stress whereas in the zone very near to the line contact between roller 15 and dielectric surface 12 where the maximum shear stress is applied complete deflocculation and breaking up of said solid phase into substantially individual electroscopic marking particles occurs resulting in this zone only in the attainment of the aforereferred to second state of the toner dispersion.

The liquid phase 18 as will be noted is released from the solid phase matrix progressively as the matrix structure is broken up. Development of the electrostatic latent image 13 does not occur in the zone where the solid phase is in a fully flocculated matrix form nor in the zone where the solid phase is deflocculated to an extent only where the electroscopic marking particles are forming large aggregates which are too large to be attracted by and adhere to said image. Development occurs only in the zone near and at the line contact between roller 15 and dielectric surface 12 where shear stress of sufficient magnitude is applied to fully deflocculate the electroscopic marking particles whereby a dispersion of same in substantially individual fine particulate form in liquid phase 18 is attained and only in such form which is corresponding to the second state as referred to in this disclosure said particles are attracted to said electrostatic latent image 13 and deposited onto said dielectric surface 12 forming image deposits 19 thereon.

It will be thus noted that in its first state the toner possesses non-Newtonian pseudo-plastic or plastic or thixotropic flow properties and developing action does not occur until the toner has been converted to its second state by the application of shear stress of appropriate magnitude whereby the flow properties of the toner become temporarily Newtonian at least as long as said shear stress is being maintained. Reversion to said first state occurs depending on the composition characteristics instantly or some time after said shear stress is removed whereupon the toner becomes again e-usable and can be again applied to the surface to be developed in the aforementioned manner.

Surprisingly the developing method of the present invention allows very highly concentrated toner dispersions to be used to develop electrostatic latent images without producing background stain and without solvent carry-out to any significant extent. This cen be explained by referring again to FIG. 2 where it will be seen that in all portions of the toner pool 14 where the solid phase has not been deflocculated to the second state extent as is the case near the line contact with roller 15 the liquid phase 18 is contained within and surrounding the solid phase and therefore is not available in sufficient quantity to wet or to be absorbed or adsorbed or chemisorbed by the dielectric surface 12 in a quantity much above that of a boundary layer. Furthermore until the second state is attained near the actual developing zone the solid phase is either so strongly flocculated or the partially deflocculated but still aggregated particles are so large generally within the range of 100–200 microns that they can not be absorbed or chemisorbed by or onto said dielectric surface 12. In the portions approaching roller 15 with increasing shear stress the liquid phase is released progressively from toner pool 14 to a sufficient extent to wet the dielectric surface 12 with a thin clear liquid film just prior to the actual developing zone near the line contact with roller 15 and such clear liquid film prevents staining of the surface in the non-image or background areas in the highest shear stress actual developing zone where the electroscopic marking particles are fully deflocculated to the fine size required for image development. The aforementioned surface wetting by said clear liquid can be generally of transient nature that is to say after passage of roller 15 across the surface being developed where if so desired said roller can also be part of a set of squeegee rollers the developed surface is substantially dry and even if some liquid is carried out it is present on the surface only in a boundary layer like quantity.

Thus it will be seen that the developing action of the toner of this invention requires the application of progressive shear stresses to convert the toner from its first state to its second state. Any mechanism capable of providing the necessary progressive shear action is thus adaptable to the present invention. Thus the developing mechanism may be as described in relation to the illustrations or may consist of a pair of rollers loaded towards each other at a predetermined pressure. One of such rollers may be wetted with a layer of the toner in its first state and in this instance image development is attained by passing the recording member being developed through the nip of these rollers in such manner that the side carrying the electrostatic latent image faces said wetted roller. Alternatively the toner in its first state may be applied directly onto the surface being developed in the form of a strip in a position just preceding the nip of said pair of rollers or preceding other means of applying the shear stress. Other mechanisms or means of applying shear stress such as for instance a blade or knife-edge of suitable material will be obvious to those skilled in the art.

It should be noted that in addition to depending on the toner composition, developing action or efficiency also depends on the speed of development on the applied shear stress and on the means of applying such shear stress as for instance in those cases where a roller is employed to apply the shear stress such roller may also act as a virtually biased or electrically biased developing electrode assisting in the developing zone the deposition of electroscopic marking particles onto the surface containing the electrostatic latent image whereby high speed development and fill-in of large solid image areas is readily attained.

The method of development in accordance with this invention will be found to be particularly advantageous in those instances where it is desired to develop electrostatic latent images representing continuous tone subject matter that is to say where grey scale reproduction is required. In such instances it is necessary to use a dispersion of very fine size electroscopic marking particles and furthermore it is essential that all such particles be of uniform size. This can be readily attained with the toners of this invention in that at the instant of converting the toner to its aforesaid second state in the developing zone the shear stress applied by the applicator such as for instance by a pressure roller can be selected to be of adequate magnitude for reducing all particle aggregates to individual fine particles of uniform size.

The liquid phase of the toner dispersion in accordance with this invention can comprise an insulative liquid having a volume resistivity in excess of $10^9$ ohm cm. and a dielectric constant of less than 3. Aliphatic hydrocarbons, aromatic hydrocarbons, chlorinated or halogenated hydrocarbons, silicone fluids and the like were found to be useful in this context. Depending on the nature of the desired solid phase composition to be used the liquid phase should comprise a material or a mixture of materials which lacks dispersing power or is characterized by low dispersing power in relation to the solid phase materials in order to flocculate the particulate matter comprising the solid phase and to form the matrix structure necessary for the aforesaid first state of the dispersion possessing non-Newtonian flow properties. This liquid phase may also contain in dissolved or partly dissolved state compounds such as natural and synthetic resins or polymers, mineral and vegetable oils, varnishes and the like which assist in or cause the flocculation of the solid phase material. Such resinous compounds and oils may also be contained in the liquid phase in dissolved or partly dissolved or swollen state for the purpose of filling or spreading the matrix structure of the flocculated solid phase in order that the therein entrapped liquid phase may be easier released from same when the appropriate shear stress is applied at the developing zone and the toner dispersion is converted to its second state. Polarity control agents or sensitizers or image enhancers can also be contained in the liquid phase in dissolved or partly dissolved state.

The solid phase of the toner dispersion in accordance with this invention can comprise particulate pigments or dyes of the desired color and substances capable of forming a matrix or bonded flocculent structure, which substances can be selected from natural and synthetic resins or polymers, mineral and vegetable oils, varnishes and the like, to be termed in the following generically as resinous matter. Such resinous matter can be present on the pigment particles in the form of a coating or can be partially adsorbed on or mixed with said pigment particles. In order to cause flocculation and strong matrix formation as required in the aforesaid first state of the dispersion said resinous matter must be insoluble or only partially swellable in the liquid phase. Such resinous matter can serve the purpose of fixing the image deposit onto the developed surface, of controlling particle charge and polarity and of acting as the primary wetter or grinding vehicle for the pigment particles. Accordingly one method of preparing the toner dispersion in its first state in accordance with this invention is to mill or grind the pigment with the resinous matter comprising the primary wetting or grinding vehicle in the liquid phase until the desired particle size reduction is attained using known means of milling such as ball mill or attritor or high speed mixer and the like where during the milling operation high shear force is applied to the material being milled and where upon ceasing the milling operation that is upon removing the shear force the dispersed solid phase flocculates in the liquid phase forming a matrix in view of the flocculative nature of the solid phase composition in relation to the nature of the liquid phase in absence of a shear stress.

It will be seen from the foregoing that except when converted to its second state by the application of shear force the toner of this invention is in its first state. This results in long shelf life stability of the toner as sedimentation or other composition change of the solid phase is prevented by the strongly flocculated matrix structure.

The following Examples will further illustrate the principles of this invention.

EXAMPLE 1

A positive toner material was prepared by ball-milling the following components for 24 hours:

| | |
|---|---|
| Carbon black pigment | 15 grms |
| Low viscosity ethyl hydroxyethyl cellulose (bond forming or flocculating substance) | 80 grms |
| 6% Zirconium octoate | 5 grms |
| Isopar G | 400 grms |

Isopar G is an isoparaffinic hydrocarbon, boiling range 320°–350°F, flash pt. 104°F, Kauri-Butanol value 26, manufactured by Exxon Corp., U.S.A.

This composition milled readily under the shear stresses applied by ball milling, but on removal from the ball jar rapidly assumed the first state previously described, in which state it was not usable as a toner for development of electrostatic latent images.

This composition was used in the manner described in reference to the illustrations to develop an electrostatic latent image formed by negatively charging and exposure to a light pattern of a commercially available electrophotographic copying paper containing photoconductive zinc oxide in an insulating resin binder on the sensitive side thereof. The image was developed at a speed of 1 inch/second, and the shear stress required to convert the toner to its second state was attained by a roller pressure producing in the developing zone at the point of line contact a load equivalent to 2 oz/inch of roller length.

EXAMPLE 2

Example 1 was repeated, with the exception that the electrostatic latent image was produced on a photoconductive recording member comprising polyvinyl n-carbazole as the photosensitive coating on a metal plate.

EXAMPLE 3

The photoconductive recording member of Example 1 was replaced with a dielectric recording member in which the dielectric layer was polyvinyl butyral. The latent image was of the alphanumerical type formed by surface charge equivalent to 25 volts negative impressed on the surface by a stylus.

EXAMPLES 4–5

The positive toner of Examples 1–2 was replaced with a negative toner of the following composition:

| | |
|---|---|
| Carbon black pigment | 10 grms |
| Pentaerythritol dimeric resin acids ester | 5 grms |
| Paraffin wax | 10 grms |
| Hydrogenated castor oil (Bond forming or flocculating substance) | 5 grms |
| Alsol 1824 | 400 grms |

Alsol 1824 is an aliphatic hydrocarbon, boiling range 362°–460°F., flash pt. 140°F, Kauri-Butanol values 33, manufactured by Esso Aust. Ltd., The composition was ball milled as in Example 1. In this case the exposure was carried out using a negative of the original subject matter in order to produce a reversed image that is to say a positive image. The image was developed at a speed of 5 inches/second, and the shear stress required to convert the toner to its second state was attained by a roller pressure producing in the developing zone at the point of line contact a load equivalent to 2oz/inch of roller length.

EXAMPLE 6

In Example 3 the alphanumerical type electrostatic latent image was formed by a surface charge of 30 Volts positive and the negative toner of Examples 4–5 was used.

EXAMPLES 7–9

The positive black toner of Examples 1–3 was replaced with a positive blue toner of the following composition:

| | |
|---|---|
| Phthalocyanine blue pigment | 10 grms |
| Ethylcellulose (bond forming or flocculating substance) | 30 grms |
| Pliolite AC-3 (bond forming or flocculating substance) | 15 grms |
| Sodium dioctyl sulphosuccinate | 5 grms |
| Low molecular weight polystyrene | 10 grms |
| Alsol 1824 | 300 grms |

Pliolite AC-3 is a modified vinyl toluene - acrylate copolymer manufactured by Goodyear Chemicals, Akron, Ohio, U.S.A.

The composition was ball milled as in Example 1. The image was developed at a speed of 15 inches per second, and the shear stress required to convert the toner to its second state was attained by a roller pressure producing in the developing zone at the point of line contact a load equivalent to 30 oz/inch of roller length.

EXAMPLES 10–12

In Examples 7–9 the image was developed by moving a Neoprene blade at a speed of 15 inches/second across the surface of the recording member which was rigidly supported. The shear stress required to convert the toner to its second state was attained by applying a pressure to the blade producing in the developing zone at the point of line contact a load equivalent to 18 oz/inch of blade length.

EXAMPLE 13

The positive black toner of Examples 1–3 was replaced with a positive red toner of the following composition.

| | |
|---|---|
| Phosphotungstomolybdic acid lake red pigment | 10 grms |
| Mowital B30H (bond forming or flocculating substance) | 50 grms |
| Sodium dioctyl sulphosuccinate | 5 grms |
| Alsol 1824 | 250 grms |

Mowital B30H is polyvinyl butyral in powder form manufactured by Hoechst AG, Frankfurt, Germany.

The composition was ball milled as in Example 1. The image was developed at a speed of 10 inches per second and the shear stress required to convert the toner to its second state was attained by a roller pressure producing in the developing zone at the point of line contact a load equivalent to 2 oz/inch of roller length.

EXAMPLE 14

The positive black toner of Examples 1–3 was replaced with a positive black toner of the following composition.

| | |
|---|---|
| Carbon black pigment | 10 grms |
| Pliolite AC-3 (bond forming or flocculating substance) | 20 grms |
| 6% Zirconium octoate | 5 grms |
| Low molecular weight polystyrene | 10 grms |
| Alsol 1824 | 250 grms |

The composition was ball milled as in Example 1. The image was developed at a speed of 30 inches per second and the shear stress required to convert the toner to is second state was attained by a roller pressure producing in the developing zone at the point of line contact a load equivalent to 20 oz/inch of roller length.

There has been described a method of and means for developing electrostatic latent images. It should be understood that the range of suitable materials and mechanisms disclosed in the examples given should be construed as illustrative only and not in a restrictive sense as other changes and substitutions may be made as will be obvious to those skilled in the art without departing from the spirit of this invention.

We claim:

1. The method of developing an electrostatic latent image contained on a surface comprising the steps of applying to said surface a dispersion in a first state wherein the flow properties of said dispersion are non-Newtonian and wherein said dispersion consists essentially of a liquid phase having a dielectric constant less than 3 and volume resistivity in excess of $10^9$ ohm cm, and of a solid phase comprising electroscopic marking particles and a resinous flocculating bonding medium therefore to establish a matrix sufficiently strong to prevent extraction of individual electroscopic marking particles from said matrix by attraction to said electrostatic latent image, and applying to said dispersion a shear stress of sufficient magnitude to convert said dispersion from said first state to a second state wherein the flow properties of said dispersion become Newtonian and wherein said solid phase is deflocculated in said liquid phase whereby individual electroscopic marking particles are attracted to said electrostatic latent image contained on said surface and deposited thereon.

2. The method of claim 1 wherein the shear force is applied progressively across the latent image progressively to develop the image.

3. The method of claim 1 wherein the developer is applied progressively by a roller moving in relation to the latent electrostatic image containing surface at a rate varying between one inch per second for a pressure of 2 ozs/inch of roller width and fifteen inches per second at a rate of 30 oz/inch of roller width.

4. The method of claim 1 wherein said flocculation bonds are formed by submitting said electroscopic marking particles to said resinous flocculating bonding medium in the liquid phase which is present in the liquid phase in a quantity such that the flow properties of the said matrix are non-Newtonian, whereby to restrain the toner particles against migration in the said matrix.

5. The method of claim 4 wherein said flocculating medium is a polymer.

6. The method of claim 2 wherein said flocculating medium is taken from the groups ethyl hydroxy ethyl cellulose, hydrogenated castor oil, and vinyl tolueneacrylate copolymer with or without the addition of ethyl cellulose, or polyvinyl butyral in powder form.

7. The method of developing an electrostatic latent image contained on a surface comprising the steps of applying to said surface by means of an applicator a dispersion held on the said applicator in a first state wherein the flow properties of said dispersion are non-Newtonian and wherein said dispersion consists of a liquid phase having a volume resistivity in excess of 10 ohm cm, dielectric constant less than 3 and a KB value between 26 and 33, and of a solid phase comprising electroscopic marking particles, and also includes in combination a resinous bonding medium whereby to form a matrix sufficiently strong to prevent extraction of individual electroscopic marking particles from said matrix by attraction to said electrostatic latent image, and applying to said dispersion by means of the said roller at the nip of the roller a progressively shear stress of sufficient magnitude to convert said dispersion from said first state to a second state wherein the flow properties of said dispersion become Newtonian and wherein said solid phase is deflocculated in said liquid phase whereby individual electroscopic marking particles can be attracted to said electrostatic latent image contained on said surface and deposited thereon.

* * * * *